US006012202A

United States Patent [19]

Kriegler et al.

[11] Patent Number: 6,012,202

[45] Date of Patent: Jan. 11, 2000

[54] TEXTILE MACHINE WITH AERODYNAMICALLY SEPARATED COMPARTMENTS

[75] Inventors: Albert Kriegler, Geisenfeld; Otmar Kovacs, Berching, both of Germany

[73] Assignee: Rieter Ingolstadt Spinnereimaschinenbau AG, Ingolstadt, Germany

[21] Appl. No.: 09/126,137

[22] Filed: Jul. 30, 1998

[30] Foreign Application Priority Data

Sep. 19, 1997 [DE] Germany ..... 197 41 278

[51] Int. Cl.[7] ..... D04H 11/00

[52] U.S. Cl. ..... 19/159 R; 19/159 A

[58] Field of Search ..... 19/159 A, 159 R; 57/90, 281; 366/110, 111, 114, 212, 240

[56] References Cited

U.S. PATENT DOCUMENTS 3,377,665 4/1968 Kincaid .
4,815,171 3/1989 Kluttermann .

FOREIGN PATENT DOCUMENTS 0255880 2/1988 European Pat. Off. .
1148473 5/1963 Germany .
3029737C2 3/1982 Germany .
3434228A1 3/1986 Germany .

OTHER PUBLICATIONS

German Patent Office Search Report, Jan. 20, 1998.
U.S. Patent Application Serial No. 09/216,783.

*Primary Examiner*—Michael A. Neas
*Assistant Examiner*—Gary L. Welch
*Attorney, Agent, or Firm*—Dority & Manning

[57] ABSTRACT

The present invention concerns a textile machine, particularly a stretch machine with a can agitation apparatus (7) and/or a can exchange apparatus (4) which is situated in a first chamber (3), which chamber (3) communicates with the space surrounding the textile machine (1). The drive mechanism (72 or 43) of the can agitation apparatus (7) and/or the can exchange apparatus is located in an additional chamber (8 or 5) which is separated from the first chamber (3) by an aerodynamic separative element (6 or 60). Through the separation elements (6 or 60), connection elements (71 or 42) extend from the drive mechanism (72 or 43) to the can agitation apparatus (7) and/or the can exchange apparatus (4). A cleaning element (9) is made available to the first chamber (3) which cleaning element (9) (not shown) is able to be brought into action at specified times.

18 Claims, 3 Drawing Sheets

FIG. 2
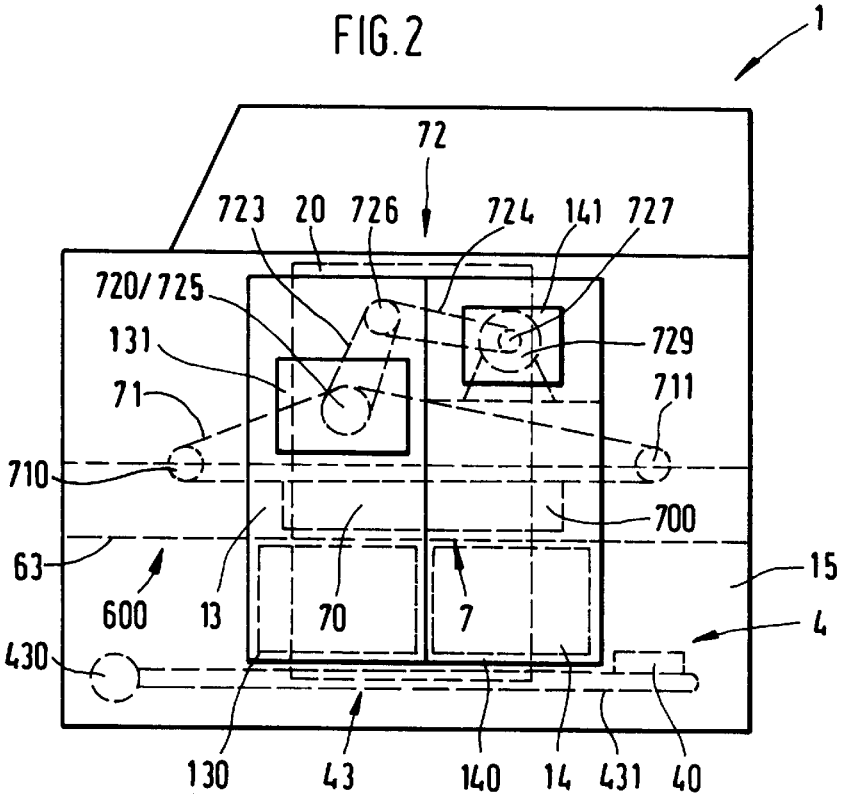
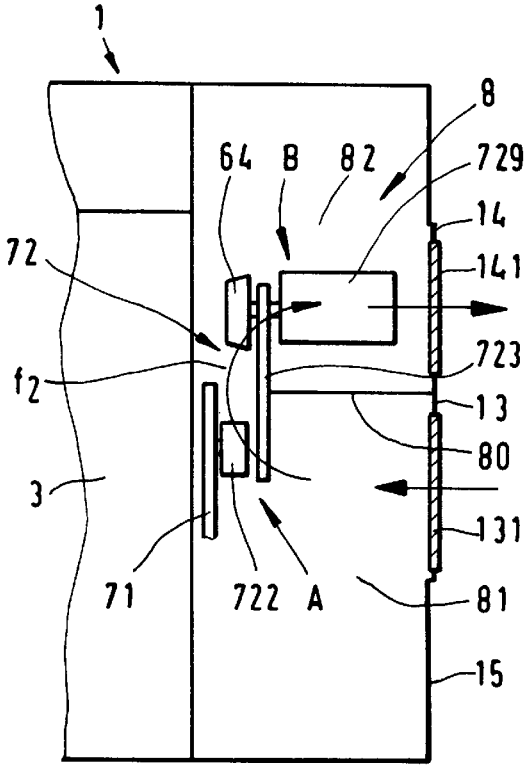
FIG. 3

FIG. 4
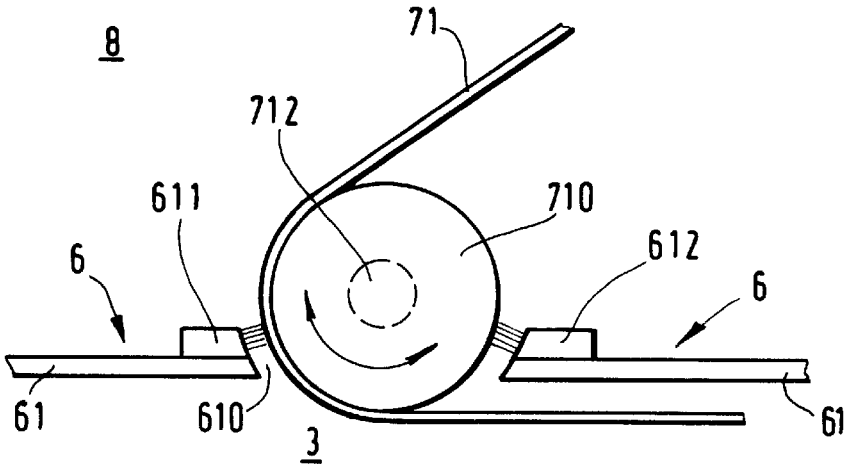
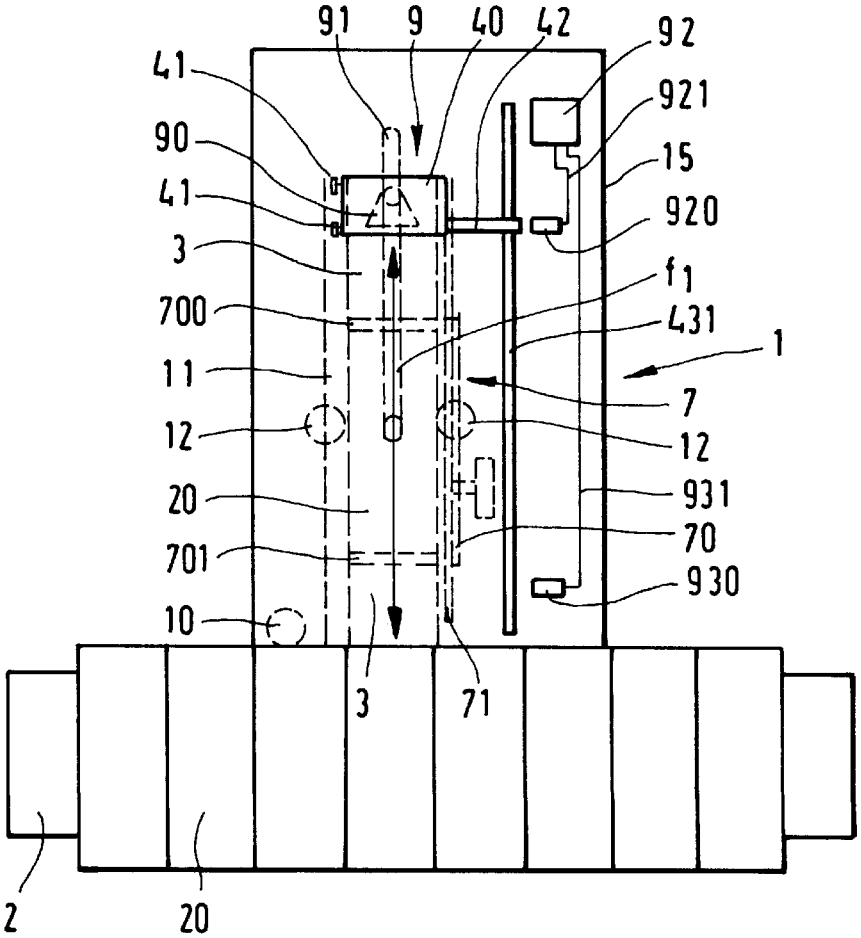
FIG.5

TEXTILE MACHINE WITH AERODYNAMICALLY SEPARATED COMPARTMENTS

BACKGROUND OF THE INVENTION

The present invention concerns a textile machine, in particular, a stretch machine with a can agitating apparatus.

In the filling of cans in a stretch machine process, it is common knowledge to agitate the flat [square cross-section] can to be filled within a chamber, which chamber communicates with the space surrounding the stretch machine (DE 40 15 938 A1, FIG. 24). Airborne particulate, which, during the filling operation, escapes from the band material fed to the can, thus remain in the said chamber. For the agitation of the can, a drive is required. This drive, as time goes on, is infiltrated with particulate and is subject to disturbances therefrom.

OBJECTS AND SUMMARY OF THE INVENTION

It is then a principal purpose of this invention to so improve the textile machine that the stated faults are avoided, and especially to prevent a particulate deposition on the agitating drive. Further in this purpose, is to avoid such deposition on other drives which are connected to said chamber. Additional objects and advantages will be set forth in the following description, or may be obvious from the description, or may be learned through practice of the invention.

This purpose will be achieved in accord with the invention by means of the features of a textile machine according to the invention. Through the placement of the can agitating apparatus in a first chamber and by the arrangement of its drive in a second chamber, which chambers are separated from one another aerodynamically by a separating barrier, the prevention of airborne particulate entering the chamber which contains the drive mechanism is achieved. In this way, disturbances which can be traced back to airborne particulate are avoided.

If the can exchange apparatus is inside the textile machine and not on a can transport wagon, which latter serves for the bringing-to and taking-away of the cans, then, in an analogous manner, airborne particulate interference with the drive of the exchange apparatus is opposed in an embodiment wherein the drive mechanism of the can exchange apparatus is located in an additional chamber, which is separated by means of a aerodynamic separative barrier from the first chamber which contains the can agitating apparatus, and through which separative barrier a connection element from the drive mechanism penetratively extends to said can exchange apparatus.

In accord with construction of the can agitating apparatus, the achievement of the purpose of the invention can be brought about independently of a design of the can exchange apparatus or carried out even in combination therewith.

Experience has shown, that the avoidance of airborne particulate is advantageous for each drive, if drives are arranged with spatial removal, one from the other, in separate chambers wherein the additional chamber which contains the drive mechanism of the can exchange apparatus is designed as a third chamber which is separated from the second chamber which encloses the drive mechanism of the can agitating apparatus. Since the drive of the can agitation apparatus and the drive of the can exchange apparatus are independent of one another, then, in accord with a preferred embodiment of the invention, the two chambers, namely for the can agitation apparatus and for the can exchange apparatus, are hermitically so separated from each other.

In order, on the one hand, to make possible access of maintenance in a simple manner to the drive which is situated in the third chamber, and at the same time to provide an assured sealing, it is advantageous if the apparatus in accord with the invention is developed such that the third chamber is enclosed by means of a maintenance door and the walls abutting the third chamber and bordering the walls adjoining the maintenance door exhibit elastic sealants. Since, the drive located in the second, as well as in the third chamber, should develop a movement lengthwise in the first chamber, it is preferred to locate these two drives in chambers situated one over the other and to seal them off.

The design of the aerodynamic separation barriers, as a sealing barrier, for example a labyrinth gasket seal, has proven itself particularly advantageous. However, yet another design which features an aerodynamically separated air flow between the chambers is entirely possible and fulfills the purpose. This design can additionally lead to the provision of a different type of aerodynamic separation means. An additional air flow, which keeps a drive free from airborne particulate, can be produced, for instance wherein the second chamber is subdivided into a suction intake space and a pressurized exhaust space which exhaust space contains a blower, and which subdivisions, by means of filters, stand in communication with the space surrounding the textile machine and with each other at their ends remote from the filters. By coordination of the design of the second chamber and by the provision of a fan, a defined air flow within the second chamber can be produced.

In order to hold to a minimum the dimensioning of the connection element between the first chamber to the second, and likewise the connection between the first chamber and the third, so that the sealed surface is as small as possible, a roller guidance is installed for the can agitating apparatus and/or the can exchange apparatus at least in the first chamber to provide the driven apparatus with low friction operation.

In an embodiment wherein the can agitating apparatus is located within a first chamber which stands in communication with the space surrounding said textile machine, to which agitating apparatus a cleaning apparatus is made available, which at least can be activated at specified time periods, the deposition of airborne particulate on a drive or on the drives can be reduced or prevented in that in the first chamber airborne particulate and other contamination and fiber components can be held in the first chamber for a longer duration. Even independently from a design of the textile machine in accord with other features according to the invention, a measure of this kind is of advantage, on which account this feature can stand alone as to its importance. In this respect, the design of a cleaning apparatus in accord with the invention has proven itself as especially valuable.

The concept of "can agitation" should, in the thought of the present invention, not be understood as limited to that type of apparatus which imparts to the can to be filled a linear motion. Much more, this concept should also encompass such an apparatus as provides the can with a different motion during filling as proves necessary, for instance, a combination of various movements or, in the case of round cans, a rotary motion.

Nor is the idea of the "can" to be limited to a special can-shape, for instance a flat can, but should also include cans of diverse shapes, for instance, a round can.

The design in accord with the invention is simple in construction and effective in operation. At the same time, the design permits the optional choice of appropriate flow restriction or aerodynamic separation in a simple manner to accommodate the respective drives which are installed and their connection elements to the driven can agitator or can exchange apparatuses.

Embodiment examples of the apparatus in accord with the invention are explained in detail below with the help of drawings relating to a stretch machine.

BRIEF DESCRIPTION OF THE DRAWINGS

FIG. 2 is a side view of a stretch machine in accord with the invention with the drive mechanisms shown in dotted lines, FIG. 3 is in section, a plan view of a portion of the drive of the stretch machine, FIG. 4 is a portion of the drive of the stretch machine in a schematic view and FIG. 5 is the stretch machine in a schematic plan view with a cleaning apparatus in accord with the invention.

DETAILED DESCRIPTION

Figure 1:
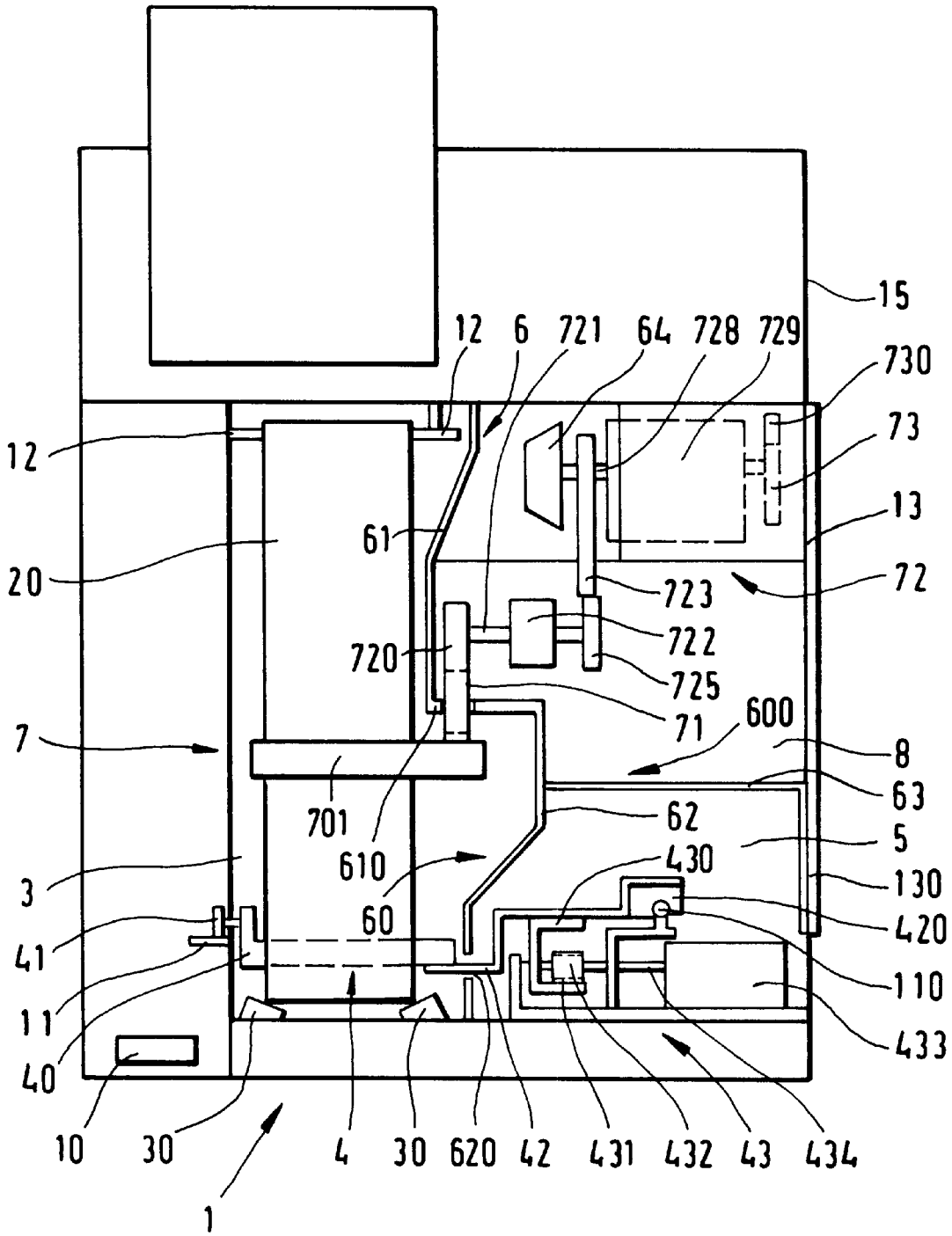
FIG. 1 is a front view of a stretch machine in accord with the invention, partially in section.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

FIG. 1 shows the stretch machine 1 designed in accord with the invention in a front view from that side on which it will be approached by a can wagon 2 (FIG. 5) bringing cans (20) to be filled, and from which at a later time said cans 20 will be removed after the filling. The can wagon takes normally a plurality of cans 20, in the shown example eight cans 20, and is maneuverable at right angles to a (first) chamber 3 of the stretch machine 1. To accomplish this purpose, the stretch machine 1 stands in a receiving position with a (not shown) mating wheel, or the like, to seize the can wagon 2 in order to bring said wagon into the desired position confronting the stretch machine 1. In this position, one of the eight cans 20 are delivered to a chamber 3 of the stretch machine 1. Conversely, the removal of a can 20 therefrom may take place and the can placed on the can wagon 2. In the process of this can exchange, (i.e. the taking out of a filled can 20 from the chamber 3 and the deposition of the same on the can wagon 2 and the presentation of an empty can 20 to chamber 3 for filling), the side of chamber 3 proximal to the can wagon 2 is open, so that said chamber 3 is in communication with the space surrounding the stretch machine 1.

The chamber 3 possesses one out of a plurality of roller conveyors comprised of rollers 30, on which the can 20 may be agitated in longitudinal direction of the chamber 3 (for agitator track, see double arrow $f_1$ in FIG. 5). To effect the agitation of the can 20, a can agitation apparatus 7 is provided in chamber 3. This agitation apparatus 7 moves the to-be-filled can 20 back and forth under a (not shown) filling head so that, in a procedure of common knowledge (and hence not shown), buckled and uniform fiber band is distributed evenly in the can 20. Contributing further to this purpose, on both sides of the agitation track, (double arrow $f_1$ in FIG. 5) are provided rollers 12, which are movable by an (not shown) oscillating traversing arrangement, generally pair-wise and at right angles to the agitation track of the can 20. The upper end of the can 20 is guided between these said rollers 12 so that the can 20, during the agitation, is tipped from one side to the other. Since, however, the filling of the can 20 is, per se, known, and thus not an object of the present invention, further description will be omitted regarding the feed and treatment of the fiber bands which are supplied in a customary manner. Likewise, for the same reasons, a description of the known filling procedure will be dispensed with.

The can agitation apparatus 7 possesses a come-along 70 which, by means of its end 700 (see FIGS. 2 and 5) which is remote from the can wagon 2, engages the to-be-filled can 20 from behind. On its end proximal to the can wagon 2, the come-along 70 exhibits a controllable pivoting arm 701, which can be swung from an idle position parallel to the can agitation track (see double arrow $f_1$ in FIG. 5) into a work position. In the said work position, the pivoting arm 701 extends parallel to the end 700 of the come-along 70 and, together with this, captures the can 20.

The come-along 70 is run, with the aid of a (not shown) guide element, which extends itself parallel to the agitation track (double arrow $f_1$ in FIG. 5), and is connected to a drive mechanism 72 by a drive belt 71, which forms a connection element and goes about two sheaves 710 and 711 (FIG. 2). This exhibits a drive sheave 720 in the same loop, which is located on the drive shaft 721 of a controllable gear drive 722.

This controllable gear drive 722 activates the movement reversals of the come-along 70 in accord with the position of said come-along 70. Since the type of gear drive 722 as well as its control system per se are known entities, a detailed description thereof will be omitted. The drive 722 is connected to the drive shaft 728 of a drive motor 729 by one or more belts 723, 724 and their respective sheaves 725, 726, and 727 (see FIG. 2). The said motor 729 is designed, for instance, as the main motor of the stretch machine 1 and drives the complete stretch works (not shown) of the stretch machine (see drive wheel 73 and belt 730 in FIG. 1.)

The drive mechanism 72 is located in a second chamber 8, which is separated from the first chamber 3 by an aerodynamically designed separation barrier 6. This aerodynamical separation barrier 6 is designed in accord with the depicted embodiment as wall 61 which shows generally a small opening 610 in the area of the sheaves 710 and 711 (see FIG. 4) for the penetration of the drive belt 71. Since the come-along 70 must travel over a greater distance, i.e., over practically the entire length of the chamber 3, then the drive belt 71 is required to extend itself over this same zone of the chamber 3. In order to be able to place the bearing 712 of the sheaves 710 and 711 outside of the chamber 3, but also inside the chamber 8, these sheaves 710 and 711 protrude only partly—through the two openings 610—into the chamber 3. At the same time, these two openings 610 are designed with so tight a fit (for instance, with a play of the general magnitude of less than a half a millimeter) that they practically form their own sealing. For the enhancement of this sealing action, provision has been made as shown in FIG. 4, that the wall 61 carries a wiping brush encompassing the protrusion of the sheaves 710, 711 and belt 71. These wiping brushes 611 and 612 in the shown embodiment are oriented radially to the sheaves 710 or 711, so that their bristles can always yield upon reversal of the travel direction of the drive belt 71 without impairing their sealing action. This reversal also effects in turn the travel direction of the can agitating apparatus 7.

Since the apparatus in its principal construction has been described, now the manner of functioning of the same is presented.

Function of the equipment

During the filling of the can 20, along with the twisted and uniform fiber band (not shown) which is deposited in the can 20, there are also single fibers, fragmented fibers and the like now in chamber 3, which have either absolutely no relation to the fiber band or they are so poorly integrated therein that they become loose. These fibers and fragments, with other like components, randomly float in the air of chamber 3 and are partially prevented from settling in the chamber 3 by the back and forth agitation movement of the can 20. These form the mentioned airborne particulate and move about uncontrolled in the chamber 3. In chamber 3, this particulate can bring about no damage, since the movable components in this chamber 3 are principally passively driven and not part of a drive mechanism.

However, for the drive mechanism 72, the airborne particulate can present a danger, since airborne particulate, by means of deposition and eroding on hot running and high RPM components of the drive mechanism, can even lead to fire. Thanks to the aerodynamic separating barrier 6, the effect is that no airborne particulate of that kind is able to enter into this second chamber 8, which contains the drive mechanism 72. In this manner, the drive mechanism 72 operates accordingly without disturbance and without danger for a long period.

Obviously, the object of the invention is not exclusively bound to the above describe design, but can be varied within the framework of the present invention in many ways, for instance by the exchange of particular elements for their equivalents or other combinations thereof. Thus it is advantageous, if the can exchange or switch (the taking out of a filled can 20 from the chamber 3 for deposition on the can wagon 2 and the bringing of an empty can 20 to be filled into the chamber 3) is carried out with the aid of a can exchange apparatus 4 installed in the stretch machine 1. A can exchange apparatus 4 of this kind is presented in FIGS. 1, 2 and 5, mainly in schematic form. It shows by the given embodiment a skid 40.

This possesses a controllable coupling arrangement (not shown), by means of which a can 20 positioned on the can wagon 2 can be fixed on the skid 40 in a manner secure in movement and slid down from the can wagon 2 and drawn into the chamber 3 of the stretch machine 1.

For a can 20 to be filled, a corresponding drive runs the can wagon 2 by means of the drive gear 10—the drive of which is not shown in the Figures since it is constructed in a conventional manner—in a customary manner into such a position confronting the chamber 3 of the stretch machine 1, that an empty can 20 is presented before the narrow side of the chamber 3. The skid 40, with the help of the drive mechanism 43, which will be described later, is then brought into such a position, that, in cooperation with the already mentioned coupling apparatus, it can be secured to the to-be-filled can 20. Thereupon, the skid pulls the can 20 into a position in which it can be taken over by the can agitation apparatus 7 for the agitation during the filling process. In this position, the coupling apparatus is activated in order to release the filled can 20. Subsequently, the skid 40 of the can exchange apparatus 4 travels to an idle position at the other end of the chamber 3 (see FIG. 5).

The skid 40 supports itself on one long side with the help of two rollers 41 on a rail 11, which runs parallel to the length of chamber 3 and thus also parallel to the agitation track (see double arrow $f_1$ in FIG. 5). On its other long side, the skid 40 is secured with a connection element 42, connected to a sliding guide 420 running on a slide rail 110. The connection element 42 is further activated by the already mentioned drive mechanism 43. This drive mechanism possesses a come-along element 430, which, in turn is bound to a drive belt 431. The drive belt 431 is powered by a drive gear 432, which is situated on an axle 434 driven by a motor 433.

The slide rail 110 as well as the drive mechanism 43 are not located in the chamber 3 with the can exchange apparatus 4, but in a separate chamber 5, which is separated from the chamber 3 by an aerodynamic separation barrier 60.

In this presented embodiment, this said separation barrier 60 is again designed as wall 62, which separates the two chambers 3 and 5 from one another and which principally exhibits a small opening 620 through which the connection element 42 of the can exchange 4 passes to its drive mechanism 43. The connection opening 620 is, in the present embodiment, designed as a narrow slit, so that a passage of airborne particulate such as fine fiber components and the like are effectively prevented and the drive mechanism 43 is protected from accumulation of said particulate. The danger of damages to the drive mechanism 43, as such damages were previously described in connection with the drive mechanism 72 of the can agitation apparatus 7, are now obviated by these measures.

In the case of the two described embodiments, the aerodynamic separation barriers 6 or 60 are mechanically constructed respectively as wall 61 or wall 62. This is, however, not a precedent setting design, but does make possible a simple realization of an aerodynamic separation barrier of the type of separation elements 6 or 60.

Respectively, at that place, at which the can agitating apparatus 7 in chamber 3 is connected with its assigned drive mechanism 72 in another chamber, i.e. chamber 8, and at which in like manner the can exchange apparatus 4, also in chamber 3, is connected with its assigned drive mechanism 43 in another chamber, i.e. chamber 5, there is found, in the case of the present embodiment, a sealing means which functions either mechanically (for instance in the form of wiping brushes 611 and 612) or pneumatically (for instance in the form of a labyrinth closure). In this case, various design possibilities arise. For instance, the slit shaped connection opening 620 may provided with lip gasketing or brush-like sealing elements (not shown). Either means would open along the moving connection opening 620 for a short period at the penetration point, in order to allow the passage of said connection element 42 and then would close again after said passage has been completed.

Or even a sealing means (also not shown) may be provided, which is so located as to float on the connection element 42, and to be led along the slit shaped connection opening 620 in an elongated guide. In this way, this sealing element closes the connection opening 620 along its entire length.

There are various measures, which contribute to achieving effective sealing in simple ways between the chamber 3 and the chamber 5 or 8, which latter contain the drive mechanisms 43 and 72. Not the least among these is a smooth operation of the can agitation apparatus 7 and or the can exchange apparatus 4. Thus, for instance, in accord with the FIGS. 1 and 5, the skid 40 of the can exchange apparatus 4 in chamber 3 is not run in any optional manner, but rather the skid 40 has a roller assisted movement (see rollers, 41). Thereby, only a small power consumption is required for the driving of the skid 40, since a rolling friction is substantially less than a drag friction. This means, that the connection element 42 between the drive mechanism 42 and the can exchange apparatus 7 need transmit only a small force, and therefor can be likewise designed with lighter construction dimensions than in the case of a pull and drag arrangement. In this way, the connection opening 620 can be held to very small dimensions, a situation which markedly simplifies the sealing between the chambers 3 and 5.

In principle, the drive mechanisms 43 and 72 can be brought together in a common chamber (not shown). However, in doing this, the danger arises that fiber and other airborne particulate can find entrance to this chamber (see FIG. 2) during a maintenance visit through an access door 13 or 14 defined through sidewall 15 (see FIG. 2). This particulate is pulled in by the more rapidly rotating elements of the drive mechanism 72, from where it migrates to the more slowly moving elements or the stationary parts during the period of the filling of the can 20, i.e. for a substantial time, and there agglomerates, thus leading to possible damage.

In order to avoid this danger, the drive mechanisms 43 and 72 are placed in separated chambers 5 and 8, which chambers are separated, one from the other, by an additional aerodynamic separation barrier 600.

Here again, the aerodynamic separation barrier 600, for reasons of simplicity, mechanically designed as wall 63. The placement of the two drive mechanisms 43 and 72 in the second and third separate chambers 5 and 8 has the advantage, that by means of the size reduction of chamber 5 or 8, in each case one of the two drive mechanisms 43, 72 achieves yet another increase in the safety of function. This is brought about because by means of a reduction in the size of the chambers 5 and 8, a corresponding reduction is made in the possibility of uncontrollable air flows into said chambers 5 and 8. In this way, for instance, the danger is removed, that particulate, which for instance comes in through the access door 13 or 14 into the chamber 5 or 8, can redistribute itself from this point again into the other chamber, i.e. 8 or 5.

Since not only the can agitation apparatus 7 but also the can exchange apparatus 4 must both be moved over the same length of the stretch machine 1, the solution became obvious to locate the chambers 5 and 8, one above the other, even when locations behind one another or placement on different sides of the chamber 2 could be subject of consideration.

Since the drive mechanism 43 is more highly endangered, because of its lower running speed and longer periods of stillstand, as compared to the drive mechanism 72, the chamber 5 is hermetically isolated from the chamber 8, a condition which is brought about by the mentioned wall 63. So that a more secure sealing is effected even in the area of the access door 13, the chamber 3 is sealed at said access door 13 with an applied, elastic gasketing 130. In case the access door 14 extends over the zone of the chamber 5, then also an applied, elastic gasketing 140 is installed on that door 14. This elastic gasket 130,—and where required gasket 140—is always installed in the wall edging of chamber 5 where it extends to the access doors 13, 14 (see, for instance, wall 63 in the FIGS. 1, 2.)

If, on the aerodynamic separation barrier 6, 60, or 600, no mechanical gasketing is provided, then, the necessary sealing function can be achieved by an appropriate formation of the connection opening 620 in the form of a more or less complex labyrinth seal.

A further possibility is to provide an appropriate air flow instead of the aerodynamic barrier 6, 60, or 600, for the purpose of blocking access of particulate to the drive mechanisms 43 and/or 72. In this case, for instance, an air curtain can be created between the chamber 3 and the chamber 5 and/or 8, in which curtain, for instance, a cross current (not shown) is produced which entrains the airborne particulate. The air stream with the particulate subsequently flows to a collection vessel, from which clean air exits through a (not shown) filter.

Yet another possibility for a pneumatic aerodynamic separation element, which can be regarded as an enhancement of one of the previously described designs, is shown in FIG. 3. Here, in schematic manner the chamber 3 is presented with the drive mechanism 72. Clearly recognizable here are the access doors 13 and 14 in sidewalls 15, which make entry possible to the drive mechanisms 43 and 72 and which, on this account, (see FIGS. 1 and 2) extend over the general elevation area of the two chambers 5 and 8 which are above one another. Each access door 13 and 14, carries a filter 131, 141 respectively, in order to permit an influx of air, and bar the entry of airborne particulate into the chambers 5, 8.

The drive mechanism 72 possesses, in accord with the previously described embodiment, as a first Main Group A, the previously mentioned gear drive 722 as well as the drive sheave 720 and the belt sheave 725. As a second Main Group B is found the mentioned drive motor 729, the belt sheave 727, as well as the drive gear 73 for the belt 730—a presentation whereof on the drawing being omitted for simplicity. Further, on the drive shaft 728 of the said motor 729 is found a blower 64 (see FIG. 1 and 3) to produce an air flow in the chamber 8, which is pulled in through the filter 131 of the access door 13 and subsequently exhausts through the filter 141 of the access door 14. To carry this out, the chamber 8, is subdivided into two compartments by wall 80 which are connected together, namely a suction space 81 and a fan exhaust space 82. The wall 80 does not cut across the entire chamber 8, but allows sufficient space so that a good drive connection is possible between the Main Groups A and B (by means of the belt 724—see FIG. 2).

Thus, the suction space 81 and the fan exhaust space 82 communicate with one another through their ends remote from their filters 131 and 141. The placement of the filters 131 and 141 in the access doors 13, 14, is such that one respectively (access door 13) is placed at the suction space 81 and the other (access door 14) is installed in the fan exhaust space 82. This arrangement is so conceived, that the air flow produced by the blower 64 (see arrow $f_2$) passes the essential elements of the two Main Groups A and B, and in doing so entrains and removes the airborne particulate. For this reason, the filters 131 and 141 are installed at different levels to direct the air stream (arrow $f_2$) in an optimal manner. The same goal can be achieved by means of appropriate baffle plates (air foil sheet metal or the like) placed within the chamber 8. The entrained airborne particles from the air stream (arrow $f_2$) deposit themselves on the filter 141 only as the air stream (arrow $f_2$) is leaving the fan exhaust space. The said filter 141 is cleaned at specified intervals.

In the foregoing, a stretch machine 1 has been described, which possesses both the can agitation apparatus 7 and the can exchange apparatus 4. The possibility also exists for deviating from the pictured and described stretch machine 1, essentially by locating the can agitating apparatus inside the stretch machine 1, while the exchange of cans is carried out with the aid of a can exchange device (not shown) provided on the can wagon 2.

The filling of non-round, i.e. "flat" cans 20 been assumed although not specifically mentioned heretofore. However, it speaks for itself, that the invention, under corresponding conformance to the necessary movements, is applicable in connection with round cans.

As already mentioned, the fiber band filling the can 20 is accompanied by loose fibers which are not incorporated in the bands and fiber fragments, etc. and enter the chamber 3 where these particles can be swirled up from time to time. Since the danger that airborne particulate of this type can intrude in the chambers 5 and 8, it is a given fact, that when such components are found in chamber 3, in an improved apparatus, the chamber 3 should be cleaned at regular or irregular periods. This cleaning can be done in various ways, for instance with the aid of a purely mechanically operating, broom type cleaning apparatus (not shown), which is activated at specified times.

FIG. 5 shows a cleaning apparatus 9 operating on a totally pneumatic basis, wherein the skid 40 possesses a suction funnel 90 which, through a hose 91 is connected with a (not shown) negative pressure source. The low pressure in the suction funnel 90 can be optionally controlled, independently of the position of the skid 40, in dependency of the position of the skid 40, or in specified time intervals.

For this purpose, and in conformity with the embodiment shown in FIG. 5, in the end area of the agitation track (see double arrow $f_1$) are provided respectively sensors 920 and 930 which are connected with control lines 921 and 931. The sensors 920 and 930 coact with the connection element 42 between the skid 40 of can exchange apparatus 4 and the drive mechanism 43, on which account this connection element 42 is designed as a switching arm. Each time one of the sensors 920, 930 is passed, an impulse is sent to the control apparatus 92. Dependent upon this impulse, the negative pressure in the suction funnel 90 is released, or conversely, broken off, so that the cleaning action is released essentially during the travel of the skid. In case it is desired, the sensors 920 and 930 can be omitted whereby the suction can be controlled from that control equipment (not shown) which sets the skid 40 in motion and stops it at both ends of its travel. In both cases, the negative pressure action of the air stream, which develops suction in the suction funnel which travels lengthwise in the chamber 3, reaches the entire length of the chamber 3, whereby also the full width of the chamber 3 comes into the suction zone of the negative pressure flow. Through appropriate design of the suction funnel 90, it can be brought about that the suction flow in the edge zones of the chamber 3 can be intensified in comparison to its action in the central zone.

Since the skid 40 must be moved back and forth upon each can exchange (the taking of full can 20 from the chamber 3 for placement on the can wagon and the bringing in of an empty can 20 for transfer to the can agitation apparatus 7) along the agitation track (see double arrow $f_1$), the chamber 3 is activated and thus cleaned and deactivated at regular intervals, as called for by the movement of the can exchange apparatus 4.

Should the chamber 3 need to be additionally cleaned, then the negative pressure in the suction funnel 90 can be released between two can exchange cycles for a short time. Moreover, it is possible, if desired, to also provide air jet cleaning on the end of the can wagon 2 proximal to the chamber 3, which adds to the intensity of the air stream directed to the suction funnel 90. If necessary, the pressurized air stream can be permanently active, even while the negative pressure in the suction funnel remains continuously active.

Thought can also be given to providing on the end of the chamber 3 proximal to the can wagon 2 a stationary suction funnel (not shown). Further consideration include providing the skid 40 with a broom, shaving blade, or the like, which, upon movement of the skid 40 for the expelling of particulate and contaminated materials from a full can 20, would direct such of those materials as have concentrated themselves on the bottom of chamber 3 into the said stationary suction funnel.

In accord with a further, not shown variance of the cleaning apparatus 9 for the chamber 3, a jet blast is provided in the area of the open narrow side of the chamber 3, which blows the airborne particulate into a collection container which is placed in a rear portion of the chamber 3, which container is, from time to time, (manually or automatically, for instance pneumatically) emptied. Other arrangements are also possible, for instance, placement of the jet blast (or another version of cleaning element of the cleaning apparatus 9) on the skid 40. In case the stretch machine 1 possesses no can exchange apparatus 4, then placing said jet blast on another element, which moves lengthwise along the chamber 3. The said element with the jet blast may even move independently of the can agitation apparatus 7, or again, together with this apparatus 7, or yet be connected to the drive belt 71.

A cleaning apparatus 9 for the chamber 3 is also of advantage, if the can 20 is shaped round and thereby is subjected to no back and forth agitating motion but rather is given a rotary movement. As already remarked above, even in such a case, requirements necessary up to this point for the drive mechanisms to provide the distributive motion during the filling of the can 20 are to be located in a chamber (not shown) aerodynamically separated from chamber 3.

The invention is not limited to the presented embodiment example. It is fundamentally applicable to other textile machines was well as stretch machines where cana are to be filled with fiber band or where cans are to be pushed, such as in carding.

PARTS LIST

| | | | |
|---|---|---|---|
| 1 | Stretch machine | 42 | Connection element |
| 10 | Drive gear | 420 | Slide guide |
| 11 | Rail (Roller guide) | 43 | Drive (Can exchange) |
| 110 | Slide rail | 430 | Come-along |
| 12 | Roller | 431 | Drive belt |
| 13 | Maintenance access | 432 | Drive gear |
| 130 | Sealing (elastic) | 433 | Motor |
| 131 | Filter | 434 | Axle |
| 14 | Maintenance access | | |
| 140 | Sealing (elastic) | 5 | Third Chamber |
| 141 | Filter | | |
| 15 | Sidewall | 6 | Separation barrier |
| | | 60 | Separation barrier |
| 2 | Can wagon | 600 | Separation barrier |
| 20 | Can | 61 | Wall |
| | 610 | Opening | |
| 3 | First Chamber | 611 | Wiping brush |
| 30 | Roller | 612 | Wiping brush |
| | 62 | Wall | |
| 4 | Can exchange appar. | 620 | Connection opening |
| 40 | Skid | 63 | Wall |
| 41 | Roller | 64 | Blower |
| 7 | Can agitation apparat. | 8 | Second Chamber |
| 70 | Come-along | 80 | Wall |

-continued

PARTS LIST

| | | | |
|---|---|---|---|
| 700 | End (of 70) | 81 | Suction space |
| 701 | Pivot arm | 82 | Fan exhaust space |
| 71 | Drive belt | | |
| 710 | Sheave | | |
| 711 | Turn-around roller | 9 | Cleaning equipment |
| 712 | Bearing | 90 | Suction funnel |
| 72 | Drive-Can agitate | 91 | Hose |
| 720 | Drive sheave | 92 | Control equipment |
| 721 | Axle/shaft | 920 | Sensor |
| 722 | Gear Drive Box | 921 | Sensor |
| 723 | Belts | 930 | Electrical line |
| 724 | Belts | 931 | Electrical line |
| 725 | Belt sheave | A | Main Grouping |
| 727 | Belt sheave | B | Main Grouping |
| 728 | Drive shaft | $f_1$ | Double arrow |
| 729 | Drive motor | $f_2$ | Arrow |
| 73 | Drive gear | f | Air flow (Claim 11) |
| 730 | Belts | | |

We claim:

1. A textile machine for processing fiber material, said machine comprising:

a driven can agitating apparatus disposed in a first chamber, said first chamber open to a space surrounding said textile machine;

a drive mechanism for said can agitating apparatus disposed within a second chamber that is separated from said first chamber;

an aerodynamic separative barrier separating said first and second chambers; and a drive member extending from said drive mechanism to said agitating apparatus through said separative barrier in a manner such that an aerodynamic seal is substantially maintained between said first chamber and said second chamber.

2. The machine as in claim 1, further comprising a driven can exchange apparatus disposed in said first chamber, and a can exchange drive mechanism disposed in a third chamber separated from said first chamber by an aerodynamic separative barrier, wherein a connection element extends from said can exchange drive mechanism to said can exchange apparatus through said separative barrier in a manner such that an aerodynamic seal is substantially maintained between said first chamber and said third chamber.

3. The machine as in claim 2, wherein said separative barrier between said third chamber and said first chamber comprises a sealing device.

4. The machine as in claim 3, wherein said sealing device is one of a labyrinth gasket or wiping brush.

5. The machine as in claim 2, further comprising a cleaning apparatus operatively disposed within said first chamber and connected to said can exchange apparatus to move within said first chamber.

6. The machine as in claim 5, wherein said cleaning apparatus is a pneumatic suction device.

7. The machine as in claim 2, wherein said second and third chambers are separated by an additional aerodynamic separative barrier.

8. The machine as in claim 7, wherein said additional aerodynamic separative barrier is a hermetic seal.

9. The machine as in claim 7, further comprising a sealable maintenance door provided in a wall defining said third chamber.

10. The machine as in claim 9, wherein said second and third chambers are disposed one above the other, said maintenance door also providing access to said second chamber.

11. The machine as in claim 7, wherein said additional separative barrier between said third and second chambers provides for a directed air flow between said third and second chambers.

12. The machine as in claim 11, wherein a suction zone and an exhaust zone is defined within said second and third chambers, and further comprising a blower disposed within said exhaust zone, said directed air flow drawn by said blower from the space surrounding said textile machine through a filter and into said suction zone, through said exhaust zone, and out of said chambers through a filter in said exhaust zone.

13. The machine as in claim 12, wherein said filters are disposed generally at the height of said can exchange drive mechanism and said can agitating drive mechanism respectively.

14. The machine as in claim 1, wherein said separative barrier comprises a sealing device.

15. The machine as in claim 14, wherein said sealing device is one of a labyrinth gasket or wiping brush.

16. The machine as in claim 1, further comprising a cleaning apparatus operatively disposed within said first compartment.

17. The machine as in claim 16, wherein said cleaning apparatus is a pneumatic suction device configured with said can agitating apparatus that takes a suction on said first compartment at specified times as can agitating apparatus moves within said first compartment.

18. The machine as in claim 16, wherein said cleaning apparatus is a pneumatic suction device movable within said first chamber.

* * * * *